United States Patent [19]

Parkhurst

[11] Patent Number: 4,461,332

[45] Date of Patent: Jul. 24, 1984

[54] COSMETIC BAG

[76] Inventor: Beverly S. Parkhurst, 260 E. Chestnut, Chicago, Ill. 60611

[21] Appl. No.: 403,010

[22] Filed: Jul. 29, 1982

[51] Int. Cl.[3] ..... A45C 13/30; A45D 33/00

[52] U.S. Cl. ..... 150/34; 150/52 J; 132/79 F; 206/235; 206/523; 206/581; 206/823; 224/901

[58] Field of Search ..... 150/34, 2.1, 2.2, 2.4, 150/52 J; 206/460, 523, 581, 235, 591, 823; 132/79 R, 79 F; 224/901; 24/306; 190/52, 109; 383/110

[56] References Cited

U.S. PATENT DOCUMENTS

| | | | |
|---|---|---|---|
| D. 11,812 | 6/1880 | Kitschelt . | |
| D. 49,173 | 6/1916 | Brock . | |
| D. 58,869 | 9/1921 | Berkowitz . | |
| D. 80,169 | 12/1929 | Danco . | |
| D. 93,573 | 10/1934 | Prout . | |
| D. 100,237 | 6/1936 | Wege . | |
| D. 105,209 | 7/1937 | Disch . | |
| D. 109,358 | 4/1938 | Ridenour . | |
| D. 158,205 | 4/1950 | Leissing . | |
| D. 176,738 | 1/1956 | St. Thomas . | |
| D. 237,841 | 11/1975 | Di Bartolo . | |
| 1,081,788 | 12/1913 | Terry | 150/34 |
| 1,281,296 | 10/1918 | Coen | 150/34 |
| 1,464,176 | 8/1923 | Freund . | |
| 2,062,237 | 11/1936 | Schwartz . | |
| 2,146,657 | 2/1939 | Stanley . | |
| 2,167,926 | 8/1939 | Glasker . | |
| 2,205,205 | 6/1940 | King . | |
| 2,261,157 | 11/1941 | Holbrook | 150/34 |
| 2,477,388 | 7/1949 | Moore | 150/34 |
| 2,555,126 | 5/1951 | Greve | 206/523 X |
| 2,695,112 | 11/1954 | Bonnevay | 206/823 X |
| 3,258,017 | 6/1966 | Albert | 206/581 X |
| 3,389,784 | 6/1968 | Hendricks et al. | 206/460 X |
| 3,503,101 | 3/1970 | Kolozsuary | 24/306 X |
| 3,851,762 | 12/1974 | Liblick | 206/460 X |
| 4,241,833 | 12/1980 | Luebcke | 190/52 X |

FOREIGN PATENT DOCUMENTS

| | | | |
|---|---|---|---|
| 2416 | 6/1979 | European Pat. Off. | 206/523 |
| 524689 | 8/1940 | United Kingdom | 132/79 F |
| 961639 | 6/1964 | United Kingdom | 150/52 J |

*Primary Examiner*—William Price
*Assistant Examiner*—Sue A. Weaver
*Attorney, Agent, or Firm*—Trexler, Bushnell & Wolters, Ltd.

[57] ABSTRACT

A cosmetic bag or case is provided for carrying cosmetic articles and the like. The bag can be any shape or size. The illustrated bag includes a top cover and a bottom cover, which can be hinged together. These covers can be made of plastic, cloth, or some other suitable, flexible or rigid material. A hook and loop strap member extends across at least part of this cover on the interior of the bag. A second hook and loop strap is adapted for mating engagement with the first strap. Padding is located adjacent the hook and loop straps. When a cosmetic article is secured between the first and second hook and loop straps, the article resiliently and frictionally engages the padding, and is thus retained in a substantially immobile position within the cosmetic bag.

8 Claims, 5 Drawing Figures

COSMETIC BAG

BACKGROUND OF THE INVENTION

This invention relates generally to cosmetic carrying cases, and more particularly concerns a bag or case which securely holds cosmetic articles in predetermined locations within the bag.

Cosmetic cases and handbags for carrying cosmetic articles have been offered in a wide variety of shapes, styles, and internal arrangements. In general, these bags are designed to carry cosmetic articles or containers of lipstick, facial makeup, mascara, and the like. Some of these bags constitute nothing more than a flexible receptacle or container, into which the cosmetic articles are dropped. When this bag is carried within a purse during an active day, or when the bag is carried as a travel case inside a suitcase, the carried articles become jumbled together. This jumbling action makes it hard to find quickly and easily a desired article. Moreover, the loose packing or jumbling can damage the article case, the article itself, or can cause the case to come open and spill the cosmetic contents into the bag.

Other cosmetic bags or cases have been adapted to hold articles securing in a pre-arranged array. These bags, too, can be inconvenient. Most provide an article arrangement which the bag maker, not the bag user, desires or selects. Some provide their own plastic containers which may be the wrong size or shape, or can hold more or less of the cosmetic than is desired by the bag user. Moreover, usually only the provided containers can be secured within the bag. Most such bags make no provision for securing articles of odd sizes, or unusual shapes, or additional cosmetic articles selected by the bag user.

It is accordingly the general object of the present invention to provide a cosmetic bag or case for carrying cosmetic articles and the like in which the articles will not become jumbled together when the bag is carried or moved.

It is another object of the invention to provide a cosmetic bag or case for carrying cosmetic articles or the like which will neatly carry, in a pre-arranged array, virtually any number of cosmetic articles of any size or shape. A related object is to provide such a bag which will carry a number of cosmetic articles in an array created by the bag user.

Other objects and advantages of the invention will become apparent upon reading the following detailed description and upon reference to the drawings. Throughout the drawings, like reference numerals refer to like parts.

DETAILED DESCRIPTION

While the invention will be described in connection with a preferred embodiment, it will be understood that it is not intended to limit the invention to this embodiment. On the contrary, it is intended to cover all alternatives, modifications and equivalents as may be included within the spirit and scope of the invention as defined by the appended claims.

Figure 1:
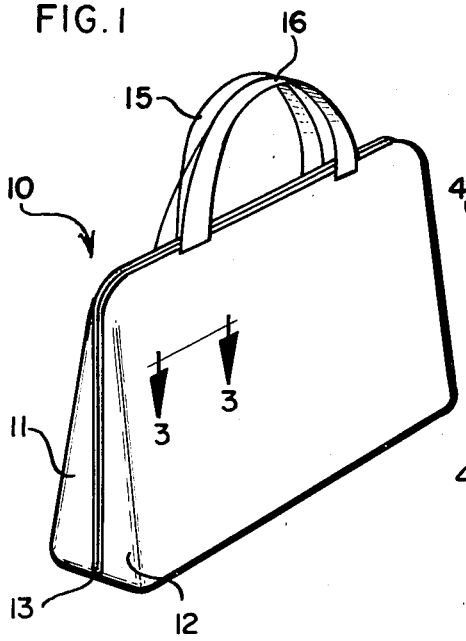
FIG. 1 is a perspective view showing a cosmetic bag embodying the present invention in its outward appearance.
Figure 5:
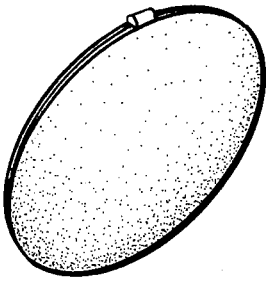
FIG. 5 is a perspective view of another cosmetic bag or case.

Turning first to FIG. 1, there is shown a cosmetic bag 10 arranged and fitted in accordance with the present invention. It will be understood that this cosmetic bag 10 can take any convenient shape, can be made of any suitable flexible or rigid outer material, and can be provided within a suitably attractive outer appearance. For exmple, the case can have the oval or clam shell shape shown in FIG. 5, and can be thin or flat so as to be easily accommodated in a purse or suitcase and readily retrieved.

Figure 2:
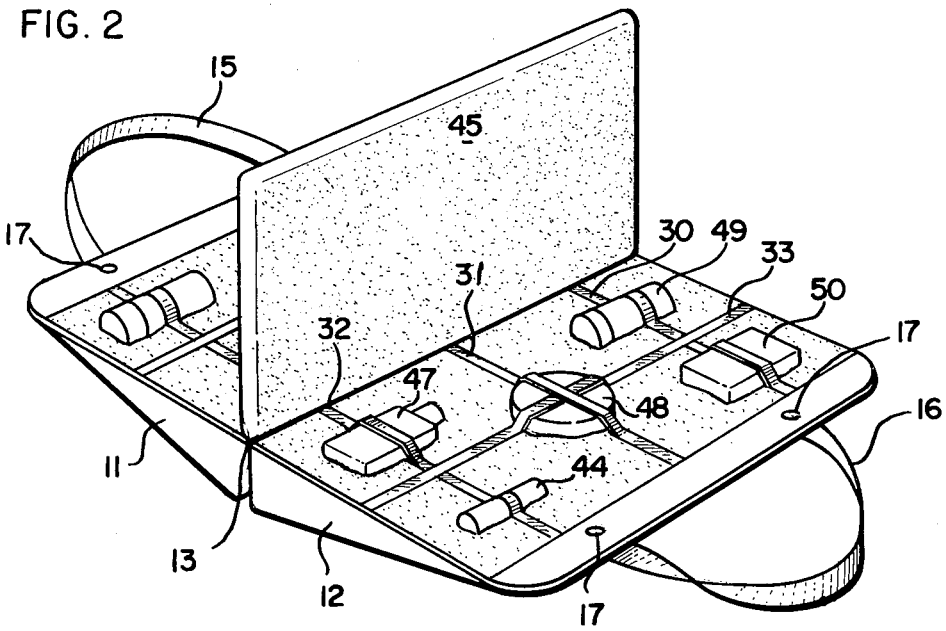
FIG. 2 is a perspective view of the bag shown in FIG. 1 showing the bag as it appears when opened, thereby exposing the bag interior.

The cosmetic case or bag illustrated in FIGS. 1 and 2, include a top cover portion 11 and a bottom cover portion 12 which are hingedly secured together along a rear spine or hinge 13. This hinge 13 can be of flexible leather or plastic, or it can take the form of a rigid hinge mechanism, or it can be some other suitable arrangement. Handles 15 and 16 can be attached to the top 11 and bottom 12, respectively. As shown in FIG. 2, fasteners 17, which can be snaps, zippers, or other suitable devices, are provided to secure the top 11 to the bottom 12 and thus close the bag 10 as shown in FIG. 1.

In the illustrated embodiment, the top cover 11 includes an outer top wall 21 and the bottom cover 12 includes an outer bottom wall 22. As explained above, these walls 21 and 22 can be formed of plastic, cloth, or other material, and can be either rigid or flexible to any desired extent.

In accordance with the invention, at least one of the covers 11 and/or 12 are provided with a first hook and loop strap member 24, which here is glued, sewn, or otherwise secured to the inside of the outer wall 21. In this embodiment, another first strap member 25 is secured to the opposite bag wall 22. Second hook and loop strap members 26 and 27 are each arranged within the bag for mating engagement across the first members over all, or at least substantial portions, of the first hook and loop members 24, 25. These hook and loop straps are offered by the White Sewing Machine Company of Cleveland, Ohio, and by the manufacturers. "Velcro" brand hook and loop fabric straps are offered by American Velcro, Inc., 681 Fifth Avenue, New York, N.Y. 10022.

As illustrated particularly in FIG. 2, these hook and loop strap assemblies can be oriented in any convenient array; here, runner strap assemblies 30, 31 and 32 can be provided, and a cross-strap members assembly 33 is included to provide additional cosmetic article securing capacity.

Figure 3:
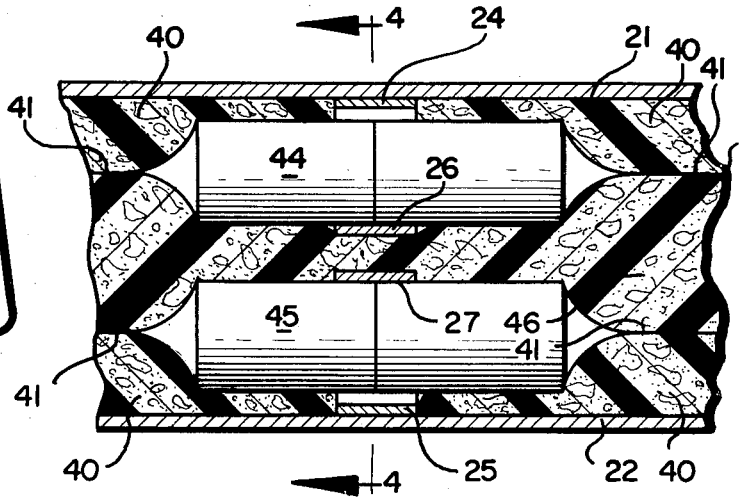
FIG. 3 is a fragmentary sectional view taken substantially in the plane of line 3—3 in FIG. 1.
Figure 4:
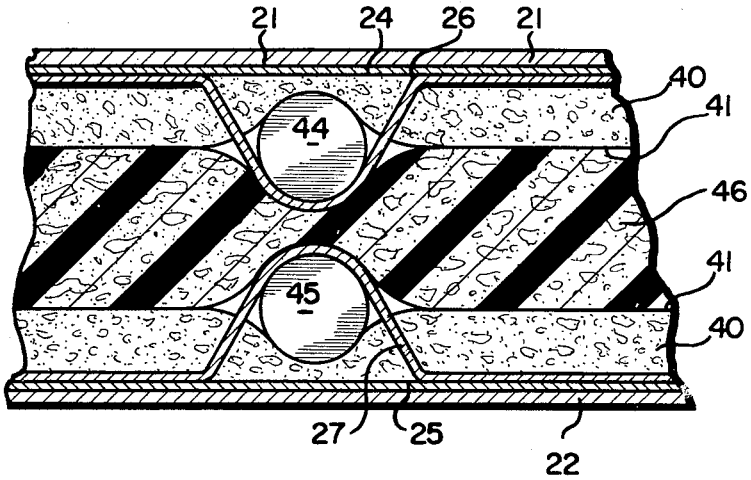
FIG. 4 is a fragmentary sectional view taken substantially in the plane of line 4—4 in FIG. 3.

In further accordance with the invention, padding 40 is located adjacent to the hook and loop straps 24–27 to help secure cosmetic articles in place in the bag. In the preferred embodiment, this padding 40 has a top surface 41 extending, when the padding 40 is uncompressed, above the top surfaces of the hook and loop strap members 24–27 (FIGS. 3 and 4). The padding is preferably selected so as to have a waffle-like pattern or other relatively high-friction surface 41, such as that found on common forms of resilient, rubberized carpet padding.

In use, a cosmetic article such as a lipstick container or tube 44 is secured between the first and second hook and loop members 24, 26. When so secured, the cosmetic article 44 or 45 is pulled partially into the surrounding padding 40, and resiliently and frictionally engages the padding surface 41. When the cosmetic article 44 is thus engaged by the hook and loop members 24, 26 or 21 and padding 40, the article is retained in an immobile position within the bag 10. This immobilization occurs even if the article 44 has a smooth, rigid, low friction outer surface.

In the preferred embodiment, a second or interior padding leaf 46 is included, and can be attached to the hinge 13 as illustrated particularly in FIG. 2. In this way, additional padding engagement with the cosmetic articles 44 or 45 is provided, thereby further helping to render the articles immobile within the bag.

As can be envisioned particularly from FIG. 2, any reasonable number of cosmetic articles 44, 45 and 48–50 can be secured within the handbag. Moreover, these articles can be arranged in any array desired by the bag user. No pre-set, pre-selected array or arrangement is required.

The invention is claimed as follows:

1. A bag for cosmetic articles and the like, comprising, in combination, a top cover means, a bottom cover means attached to the top cover means, a hook and loop strap member extending across at least part of the interior of the bag, padding means within the bag and adjacent to the hook and loop member, and having a top surface extending, when the padding is uncompressed, above the top surface of the hook and loop strap member, means co-operating with the hook and loop strap member to retain the hook and loop strap member in a selected position within the bag and relative to the padding, whereby a cosmetic article can be secured between the hook and loop member and the padding means and resiliently pulled into and substantially engaged by the padding means, so as to retain the cosmetic article in a substantially immobile position within the cosmetic bag.

2. A bag according to claim 1 wherein said top cover means and bottom cover means are hingedly attached.

3. A cosmetic bag according to claim 1 further including fastener means for fastening the bottom means to the top means in a bag closed condition.

4. A bag according to claim 1 further including a padding leaf interposed between the top cover means and the bottom cover means, whereby to provide additional padding restraint and engagement with the carried cosmetic article.

5. A cosmetic bag according to claim 4 wherein said padding leaf is hingedly attached to the top and bottom cover means.

6. A cosmetic bag accordng to claim 1 wherein said padding means is provided with a frictionally aggressive top surface.

7. A cosmetic bag according to claim 1 wherein said first hook and loop strap member is secured to the interior of one of said cover means.

8. A bag for cosmetic articles and the like, according to claim 1 having, in the bag interior, a first hook and loop strap, a second hook and loop strap adapted to engage the first strap and accommodate a cosmetic article therebetween, and padding means surrounding at least the first hook and loop strap for engaging the cosmetic article, the straps and padding thereby cushioning the article and retaining the article in a substantially fixed position in the bag.

* * * * *